US005472515A

United States Patent [19]

Roberts et al.

[11] Patent Number: 5,472,515

[45] Date of Patent: Dec. 5, 1995

[54] APPARATUS FOR THE PRETREATMENT OF MOVING METAL STRIP

[75] Inventors: Timothy R. Roberts, Owensboro, Ky.; Richard P. Metzinger, Redlands, Calif.

[73] Assignee: Worldsource Coil Coating, Inc., Hawesville, Ky.

[21] Appl. No.: 283,779

[22] Filed: Aug. 1, 1994

[51] Int. Cl.[6] ..... C23G 1/19

[52] U.S. Cl. ..... 134/15; 134/26

[58] Field of Search ..... 134/15, 26, 10; 266/112

[56] References Cited

U.S. PATENT DOCUMENTS

| | | | |
|---|---|---|---|
| 2,234,593 | 3/1941 | Ferm et al. | 134/15 |
| 2,314,369 | 3/1943 | Reed | 266/112 |
| 2,529,762 | 11/1950 | Brisse | 134/15 |
| 5,348,628 | 9/1994 | Ishibashi et al. | 134/26 |

*Primary Examiner*—Scott Kastler

*Attorney, Agent, or Firm*—Waddey & Patterson; Edward D. Lanquist, Jr.

[57] ABSTRACT

The present invention discloses a specifically designed pretreatment cell. This pretreatment cell consists of a tank having an entry end and an exit end. A metal web is introduced into the tank proximate the entry end and removed from the tank proximate the exit end. In between, three submergence rollers force a portion of the web into a pretreatment solution housed by the tank. These submergence rollers are placed such that the center roller penetrates deeper into the tank than the other two. Weirs are incorporated to raise or lower the level of the fluid and thereby modifying the length of the portion of the strip that is submerged in the fluid. Within the tank, a counterflow nozzle directs the pretreatment solution along the metal web in a direction opposite to the direction in which the web is running. An supply nozzle is also provided to deliver fluid into the tank. Attached to the tank there are also one or more removal areas. The counterflow nozzle and the entry supply nozzle direct the sludge created by the system generally toward the removal area thereby reducing the amount of sludge that can end up in a comer of the tank.

15 Claims, 8 Drawing Sheets

APPARATUS FOR THE PRETREATMENT OF MOVING METAL STRIP

BACKGROUND OF THE INVENTION

The present invention relates generally to a system and method for treating a metal strip with reactive chemicals and more particularly to a system and method for pretreating running webs of metal prior to coil coating.

It will be appreciated by those skilled in the art that metals must be cleaned of protective films such as oils and then pretreated in some manner in order to provide adhesion and corrosion resistance to the finished product. Although it is easy and inexpensive to treat a single sheet of metal, coil coating is performed at relatively high speeds. Therefore, the strip must be pretreated at similar speeds. In the past, coating has been performed by having a multi compartmented system having a portion of which pretreats the running coil of metal in a pretreatment bath. Unfortunately, this prior system has several drawbacks. The fluid is usually a reactive species which generates reaction by-products, "sludge", when interacting with the coil. Sludge building up in the bath often works its way into comers and other nooks and crannies. Therefore, when the pretreatment solution is changed out, the sludge must be physically removed from the nooks and crannies after it has been given a chance to accumulate. Further, metal web running at a relatively high rate of speed is immersed or submerged in the pretreatment bath for only a certain period of time. Lengthening the amount of time in the bath slows down the process. However, shortening the amount of time that the running web is submerged in the bath reduces the efficiency of the pretreatment thereby allowing sludge material to remain on the running web thereby decreasing the ability to coat the material. Also, the sludge created in the system that is left in the system for a long period of time continues to react with the pretreatment fluid thereby reducing the amount of pretreatment fluid that can actually react with the running web. Further, sludge remaining in the pretreatment fluid as it continues to react with the pretreatment fluid reduces the life span of a given amount of pretreatment fluid thereby increasing the amount of fluid required and increasing the amount of fluid that must be taken care of pursuant to EPA requirements. Further, the prior art provided that the only method of controlling the bathing time was to increase or decrease the web speeds and consequently alter the immersion time.

What is needed, then, is a treatment system that incorporates by design the ability to modify the immersion time very quickly and easily. This needed system and method must also provide for a high mass transfer of reactive species to the strip. This needed system and method must eliminate sludge build up and allow for a rapid change out of one type of chemical treatment to another. This needed system and method must also reduce the amount of chemical that is actually used and that must be disposed of. This needed system and method must reduce the amount of bathing time required by the web. This needed system and method must increase the amount of materials removed from the surface of the metal web. This needed system and method is presently lacking in the prior art.

SUMMARY OF THE INVENTION

The present invention discloses a specifically designed pretreatment cell. This pretreatment cell consists of a tank having an entry end and an exit end. A metal web is introduced into the tank proximate the entry end and removed from the tank proximate the exit end. In between, three submergence rollers force a portion of the web into a pretreatment solution housed by the tank. These submergence rollers are placed such that the center roller penetrates deeper into the tank than the other two. Weirs are incorporated to raise or lower the level of the fluid and thereby modifying the length of the portion of the strip that is submerged in the fluid. Within the tank, a counterflow nozzle directs the pretreatment solution along the metal web in a direction opposite to the direction in which the web is running. A supply nozzle is also provided to deliver fluid into the tank. Attached to the tank there are also one or more removal areas. The counterflow nozzle and the entry supply nozzle direct the sludge created by the system generally toward the removal area thereby reducing the amount of sludge that can end up in a comer of the tank.

Accordingly, one object of the present invention is to provide a device which easily controls the length of the portion of the running web which is submerged.

Still another object of the present invention is to provide a system and method which effectively pretreats running metal web.

A still further object of the present invention is to provide a device which removes the sludge created by a pretreatment system to prevent it from fouling the system, reducing the amount of time that the sludge has to react with the pretreatment fluid, and allowing ease of switching out one pretreatment fluid for another.

A still further object of the present invention is to provide a method and device which directs pretreatment fluid counter to the flow of the running web.

A still further object of the present invention is to reduce the amount of pretreatment fluid required.

A still further object of the present invention is to provide a system and method which better pretreats the running web in a manner that is also more efficient.

DESCRIPTION OF THE PREFERRED EMBODIMENT

Figure 1:
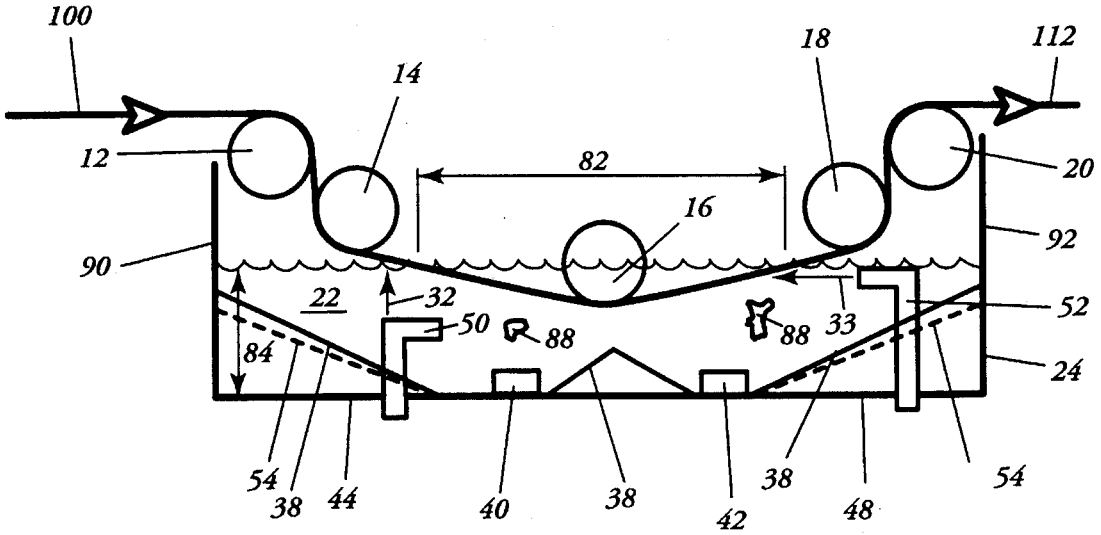
FIG. 1 is a side view of one embodiment of the present invention.

Referring now to FIG. 1, there is shown generally at 10 the device for pretreatment of a moving web of the present invention. In this embodiment, device uses first and second delivery rollers 12 and 14 attached to tank 24 proximate entry end 90. Similarly, removal rollers 18 and 20 is attached to tank 28 proximate exit end 92. Tank 24 contains pretreatment or reactive solution or fluid 22. In between entry end 90 and exit end 92, portion 80 of web 100 is submerged in fluid 22 having length 82. Submergence roller 16 works with rollers 14 and 18 to lower portion 80 into fluid 22 with roller 16 penetrating deepest into tank 24. In the particular embodiment, length 82 of portion 80 is controlled by level 84 of fluid 22 as determined by specially designed weirs 60 which will be discussed in connection with FIG. 3. As level 84 of fluid 22 is lowered, length 82 of portion 80 decreased so that its submergence also decreases. Conversely, as weirs 60 are adjusted to raise level 84, length 82 of portion 80 increases so that the amount of time that portion 80 is submerged increases. Length 82 of portion 80 is measured along web 100 in the direction that web 100 travels through fluid 22.

Referring still to FIG. 1, there is shown generally at 50 entry supply nozzle and at 52 exit supply nozzle. Nozzles 50, 52 supply fluid 22 to tank. If nozzles 50, 52 supply more fluid than is withdrawn, level 84 raises. The converse is as true. Additionally, nozzle 50 projects fluid 22 in transverse vector 32 whereas nozzle 52 projects fluid 22 in counter-vector 33 to direct sludge 88 created by system 10 toward entry collection area 40 and exit collection area 42 for removal from system. To further assist system 10 in removing sludge 88, trough 54 is placed in bottom 38 of tank 24 to assist collection.

Referring still to FIG. 1, there is shown generally at 52 the counter flow nozzle of the preferred embodiment of the present invention. As can be seen in FIG. 1, web 100 runs in travelling direction 112. Running web 100 through fluid 22 still allows certain absorbed surface layer material to remain on web 100. Counter flow nozzle 52 directs a physical force against web 100 in counter-direction 33 thereby increasing the efficacy of the process. The physical counter-flow works in connection with the chemical reaction to remove additional sludge 88 from web 100. In addition to entry supply transverse nozzle 50 and exit supply nozzle 52, counterflow nozzle 52 also projects fluid 22 toward removal areas 40, 42.

Figure 2:
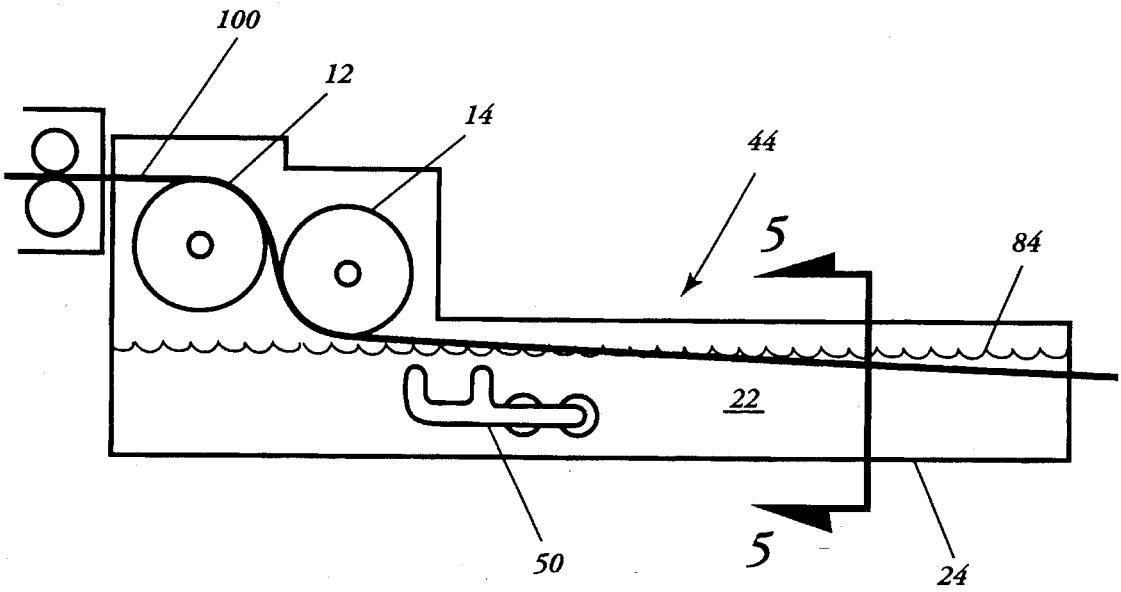
FIG. 2 is a side view of the entry section of the present invention.
Figure 3:
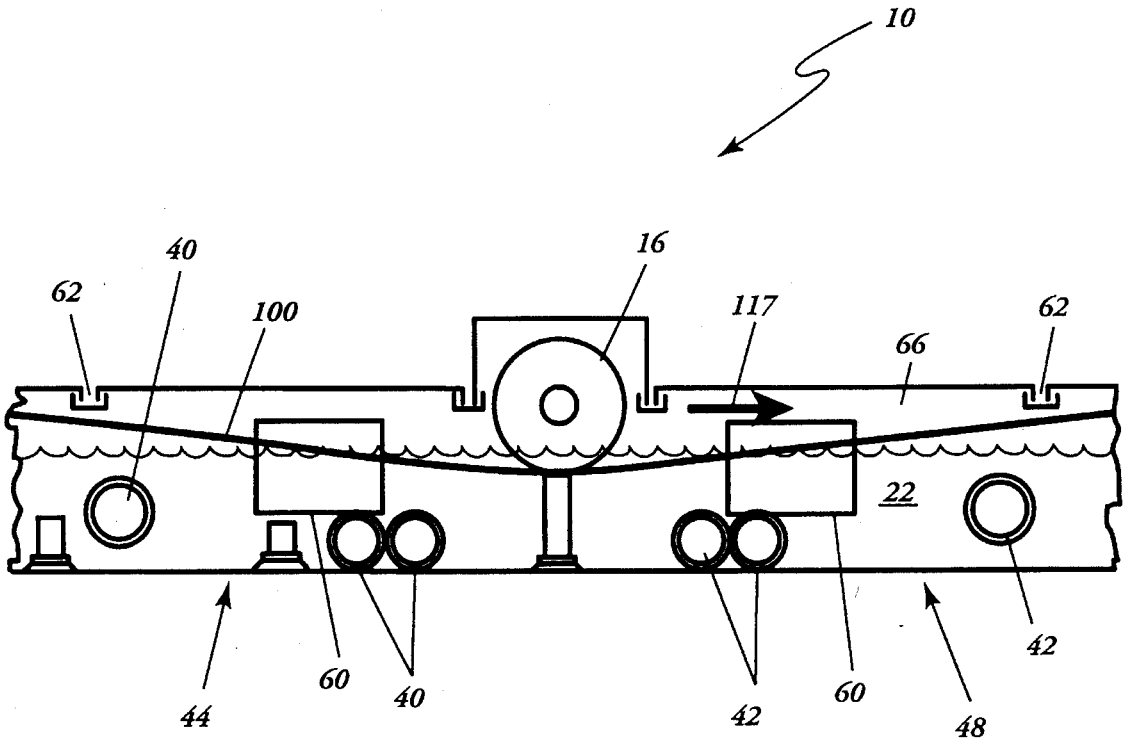
FIG. 3 is a side view of the middle section of the present invention.
Figure 4:
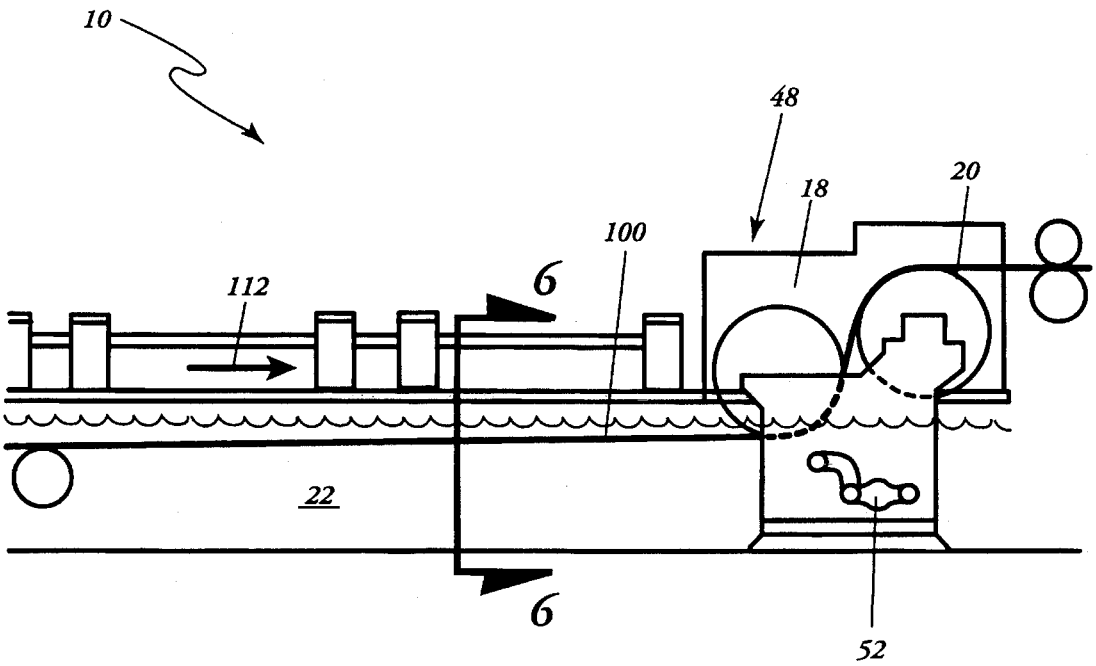
FIG. 4 is a side view of the exit portion of the present invention.

For the sake of discussion, and because system 10 is so long in nature, system 10 can be divided into three visual sections. In FIG. 1, most of entry section 44 is shown which is also shown in FIG. 2. The intersection of entry section 44 and exit section 48 is shown in FIG. 3 which is at roller 16. Finally, exit section 48 in FIG. 1 is shown in FIG. 4.

Referring now to FIG. 2, there is shown generally at 44 the entry section of device 10 of the present invention. In this embodiment, first delivery roller 12 and second delivery roller 14 direct web 100 into tank 24. Entry section supply nozzle 50 as described in FIG. 1 is attached to tank 24. Level of pretreatment fluid 22 in tank 24 is controlled by increasing the amount of flow into tank 24 by, among other things, supply nozzle 50 and counter-flow nozzle 52.

Figure 5:
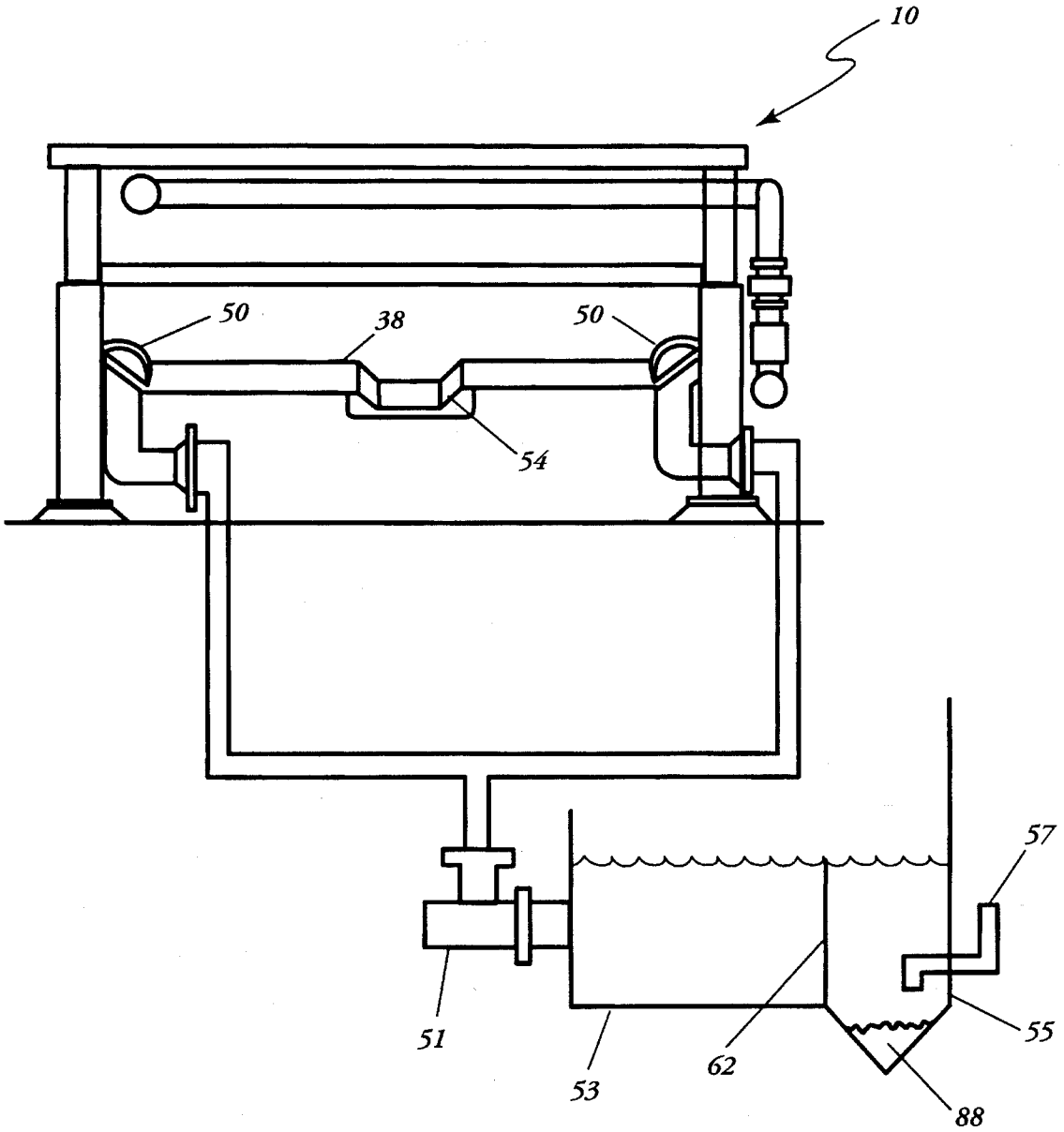
FIG. 5 is a cut away view along lines A—A in FIG. 2 of the entry supply nozzle of the present invention.

Referring now to FIG. 5 there is shown a cross-section of system 10 taken along line A—A of FIG. 2. This view shows entry supply nozzles 50, pumps 51 direct pretreatment fluid 24 through entry supply nozzles 50 into tank 24. Further, FIG. 5 also shows shape of floor or bottom 38. Bottom 38 is provided with trough 54 which assists in collecting sludge 88. Further, as stated before, entry supply nozzles 50 and counterflow nozzle 52 direct sludge 88 created by the system toward a collection area to be shown later. FIG. 5 also demonstrates part of the recycling nature of system 10. Return 57 receives materials from collection areas (discussed later). Removed liquid passes through sludge cone 55 which collects sludge 88. Fluid 22 having sludge 88 removed flows over sludge weir 65 and into holding reservoir 53 before travelling through pump 51 and out nozzles 50 and 52.

Figure 7A:
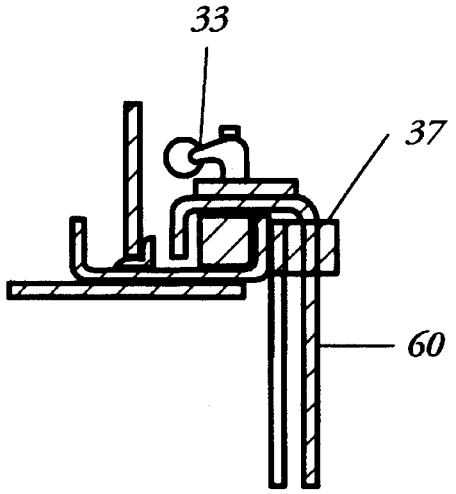
FIG. 7*a* is a cutaway along lines C—C of FIG. 3.
Figure 7B:
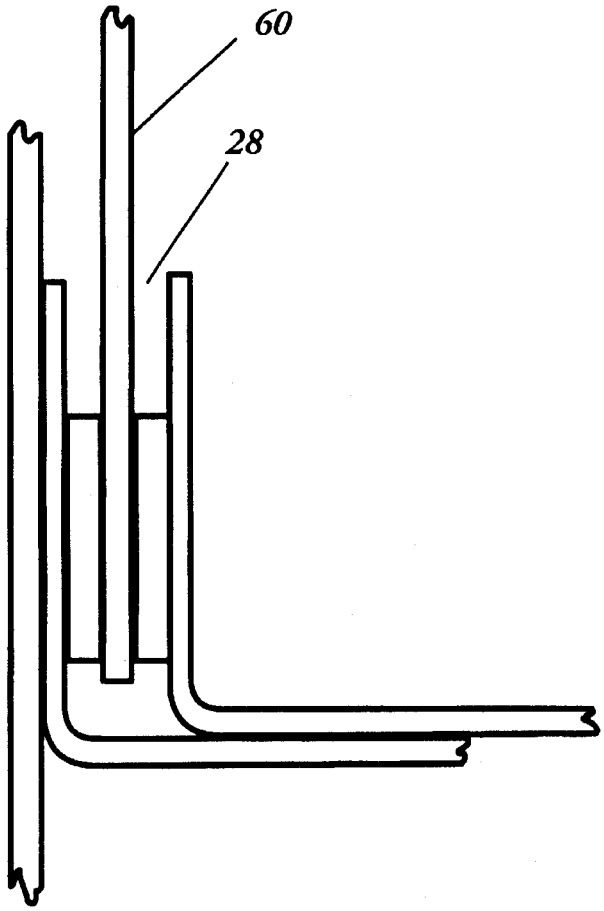
FIG. 7*b* is a side detail of the weir assembly.

Referring now to FIG. 3, there is shown generally the intersection between entry section 44 and exit section 48 of system 10 of the present invention. Web 100 is submerged into fluid 22 by submergence roller 16. One important feature of one embodiment of submergence roller 16 in FIG. 3, which also applies to rollers 12, 14, 16, 18, is that the beatings are not exposed to pretreatment fluid 22 thereby keeping the pretreatment fluid 22 from corroding the beatings. As web 100 travels along direction 112, pretreatment fluid 22 is being directed transverse by the entry supply nozzles 50 shown in FIGS. 1 and 2. This directs sludge toward first or entry collection area 40 which is basically a negative pressure pump. Prior to web 100 reaching submergence roller 16. Just as there is entry collection area 40, there is also exit or second collection area 42. FIG. 3 and FIGS. 7*a* and 7*b* also show the two methods of increasing the amount of web 100 which is submerged. Level 84 of fluid 24 can be raised by increasing inflow of fluid 24 as discussed above or by weirs 60 which can be moved horizontal thereby raising or lowering level 84 of fluid 22 as shown in FIG. 3 shows weir gates 60. Weir gates 60 travel along channel 28 and held in place by lock pins 33.

Figure 6:
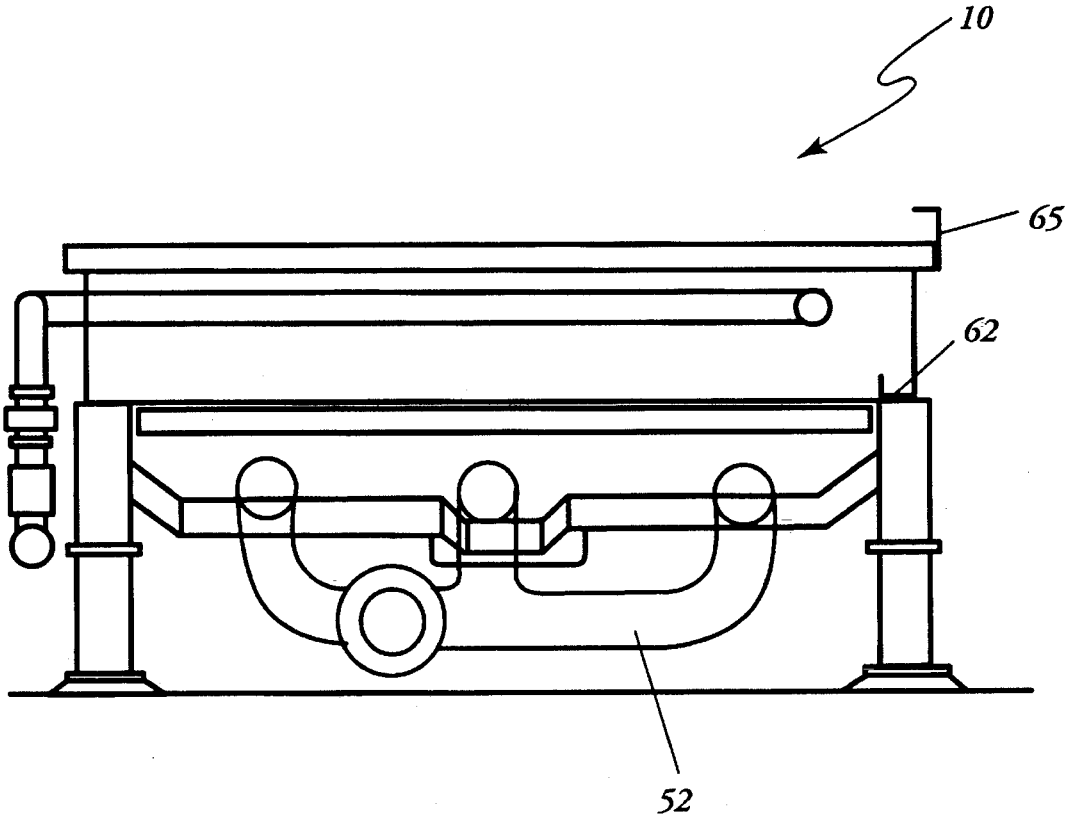
FIG. 6 is a cut away along lines B—B of FIG. 4 showing the counter flow nozzle of the present invention.

Referring now to FIG. 4, there is shown generally at 48 the exit section of device 10 of the present invention. As was discussed in FIG. 2, rollers deliver web 100 through system. Similarly, first removal roller 18 and second removal roller 20 remove web 100 from system 10 along direction 112. As web 100 is being directed along direction 112, counter flow nozzle 52 projects and directs fluid 22 counter to flow 112. As can be seen in combining FIG. 4 and FIG. 6, counter flow nozzle 52 directs flow counter to direction 112 across width of web 100. Pump for counterflow nozzle is similar to that shown in connection with entry supply nozzles 50 in FIG. 5.

Figure 8:
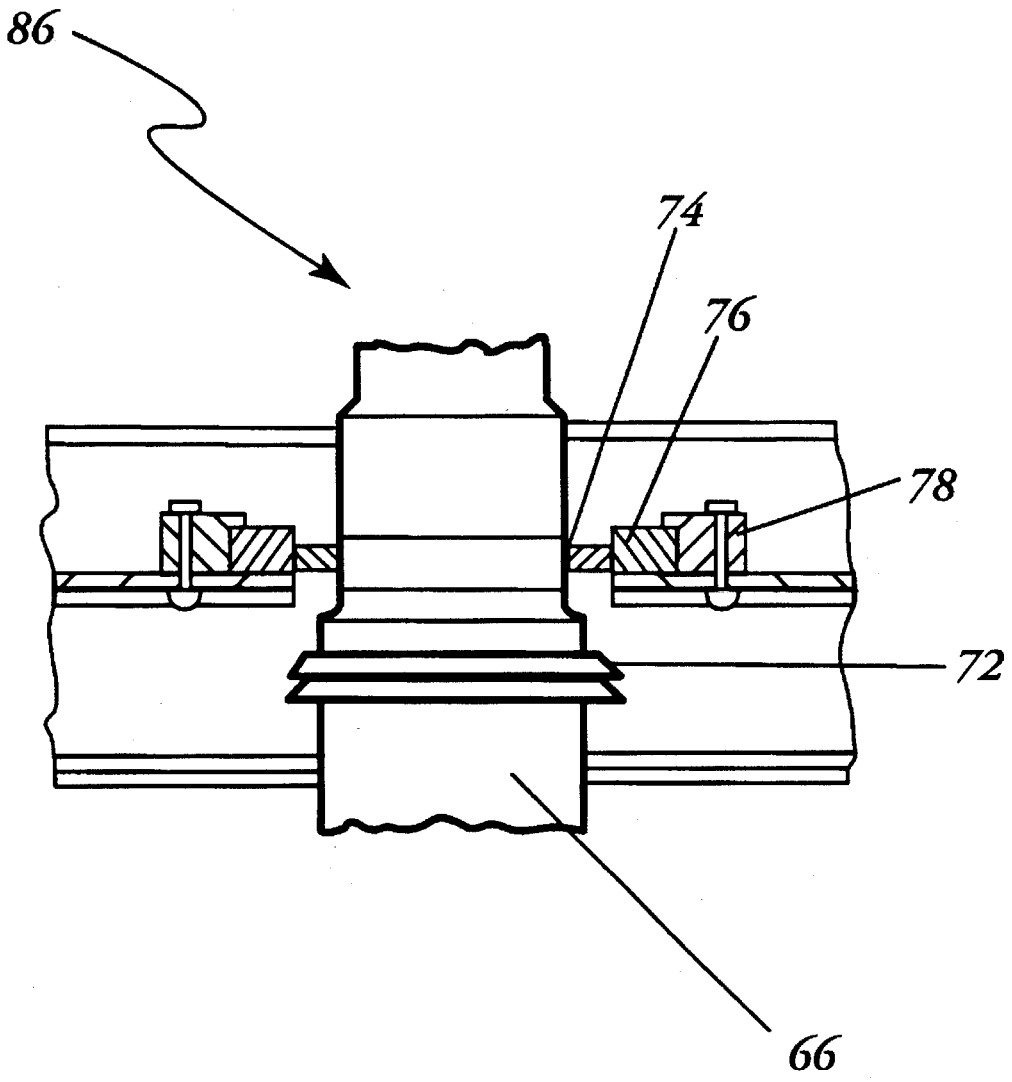
FIG. 8 is a side view of the seal of the present invention.

Another unique feature of the pretreatment cell is the vapor and splash containment system 86. FIG. 8 shows the detail of the outboard bearing vapor/splash protection device 86 consisting of double slinger ring 72, seal device 74 held in place by a slide positioner 76 which is held in place by a block 78. These items allow for a positive seal between the roll shaft 66 and the side of the pretreatment cell while still allowing shaft 66 to turn. The channels 62 and lid bottoms 65 form another positive seal as shown also in FIG. 6.

Thus, although there have been described particular embodiments of the present invention of a new and useful apparatus for the pretreatment of moving metal strip, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What we claim is:

1. A method for pretreating a metal web comprising the steps of:

a. moving said metal web along a path;

b. submerging said moving metal web in a solution of pretreating fluid; and c. projecting said pretreating fluid along said submerged metal web to create a flow counter to said path with a jet.

2. The method of claim 1 further comprising the step of removing sludge from said pretreating fluid created by said projected fluid through a trough in said tank.

3. The method of claim 1 further comprising the step of forcing sludge from said pretreating fluid created by said projected fluid toward a removal area.

4. The method of claim 3 further comprising the step of removing sludge from said pretreating fluid created by said projected fluid from a trough in said tank.

5. The method of claim 1 further comprising the step of directing said pretreating solution against said metal web.

6. The method of claim 1 further comprising the step of controlling the portion of said metal web submerged in said pretreating fluid.

7. A system for pretreating a metal web comprising:

a. a tank having an entry end and an exit end, a first side and a second side, and a bottom having a trough to collect sludge, said metal web running through said tank in a direction from said entry end to said exit end;

b. a pretreatment fluid received by said tank;

c. means attached to said tank for submerging a portion of said metal web having a length in said pretreatment fluid; and d. means attached to said tank for projecting said pretreatment fluid along said metal web counter to said direction.

8. The system of claim 7 further comprising:

a. means attached to said tank proximate said entry end for delivering said metal web into said tank proximate said entry end; and b. means attached to said tank proximate said exit end for removing said metal web from said tank proximate said exit end.

9. The system of claim 7 further comprising means attached to said tank for controlling said length of said portion of said metal web which is submerged.

10. The system of claim 9 wherein means for submerging said metal web comprises a submergence roller.

11. The system of claim 9 wherein said means for controlling said length of said portion of said metal web which is submerged comprises a weir.

12. The system of claim 7 wherein said means for projecting said pretreatment fluid along said metal web counter to said direction comprises a counterflow nozzle.

13. The system of claim 7 further comprising means for projecting said pretreatment fluid against said metal web.

14. The system of claim 7 further comprising means for directing sludge created by said system toward said trough.

15. A system for pretreating a metal web comprising:

a. a tank having an entry end and an exit end, a first side and a second side, and a bottom having a trough for collating sludge, said metal web running through said tank in a direction from said entry end to said exit end;

b. a pretreatment fluid received by said tank having a level;

c. means attached to said tank for submerging a portion of said metal web having a length in said pretreatment fluid;

d. a port attached to said tank proximate said bottom for removing sludge created by said system;

e. a counterflow nozzle attached to said tank for projecting said pretreatment fluid along said metal web counter to said direction and directing said sludge toward said port;

f. a projection nozzle for directing said pretreatment fluid against said metal web and said sludge toward said port; and g. means attached to said tank for controlling said length of said portion of said metal web which is submerged.

* * * * *